US006886303B2

(12) United States Patent
Schmidt

(10) Patent No.: US 6,886,303 B2
(45) Date of Patent: May 3, 2005

(54) FORM BRACING TIE BRACKET FOR MODULAR INSULATING CONCRETE FORM SYSTEM AND FORM USING THE SAME

(76) Inventor: Donald L. Schmidt, 425 Second Ave., SW., Oronoco, MN (US) 55960

( * ) Notice: Subject to any disclaimer, the term of this patent is extended or adjusted under 35 U.S.C. 154(b) by 110 days.

(21) Appl. No.: 09/932,096

(22) Filed: Aug. 20, 2001

(65) Prior Publication Data

US 2003/0033782 A1 Feb. 20, 2003

(51) Int. Cl.[7] ..... E04B 1/02

(52) U.S. Cl. ..... 52/562; 52/565; 52/309.12; 52/309.17; 52/309.16; 52/426; 52/428; 52/431; 52/438; 52/442

(58) Field of Search ..... 52/562, 565, 309.12, 52/309.17, 309.16, 426, 428, 431, 438, 442

(56) References Cited

U.S. PATENT DOCUMENTS 4,730,422 A * 3/1988 Young ..... 52/105
5,459,971 A 10/1995 Sparkman
5,657,600 A * 8/1997 Mensen ..... 52/426
5,845,449 A * 12/1998 Vaughan et al. ..... 52/565
5,896,714 A * 4/1999 Cymbala et al. ..... 52/426
6,308,484 B1 * 10/2001 Severino ..... 52/426

* cited by examiner

*Primary Examiner*—Carl D. Friedman
*Assistant Examiner*—Steve Varner
(74) *Attorney, Agent, or Firm*—Siemens Patent Services LC

(57) ABSTRACT

A tie bracket for supporting opposing synthetic foam insulating panels of a concrete receiving form, and a form utilizing such brackets. The tie bracket has intersecting horizontal and vertical members forming circumferentially closed openings therein. Most openings are arranged in horizontal series. An upwardly open trough is formed in each tie bracket. The horizontal members span and connect spaced apart parallel plates. The plates of each tie bracket are embedded in one foam insulating panel and are of height equal to that of the insulating panel. Each insulating panel has projections formed in its upper surface and cooperatively formed notches formed in its lower surface to enable interlocking and alignment of vertically stacked forms.

16 Claims, 3 Drawing Sheets

FORM BRACING TIE BRACKET FOR MODULAR INSULATING CONCRETE FORM SYSTEM AND FORM USING THE SAME

REFERENCE TO RELATED APPLICATIONS

This application is related to application Ser. No. 09/932,095 entitled CORNER FORM FOR A MODULAR INSULATING CONCRETE FORM SYSTEM and Ser. No. 09/932,081 entitled MODIFIED FLAT WALL MODULAR INSULATING CONCRETE FORM SYSTEM, filed concurrently herewith on Aug. 20, 2000.

BACKGROUND OF THE INVENTION

1. Field of the Invention

The present invention relates to modular insulating concrete forms of the type which receive poured concrete and are abandoned in place after pouring, thereby becoming an integral part of a static structure being built. The invention is particularly applicable to residential and light commercial construction. The novel forms are usable by homeowners, contractors, municipal, industrial, and institutional personnel in building and improving existing structures wherever insulated load bearing walls are to be built from poured concrete.

2. Description of the Prior Art

Left-in-place insulting concrete forms for building walls from poured concrete are known. In commercial practice, courses of forms are stacked until the final desired height of a wall is attained. Concrete is poured into the erected forms and allowed to cure. Erection of multi-course forms prior to pouring concrete must be carefully performed. It is necessary that the forms be properly aligned with respect to one another to assure that finished wall surfaces are flat and flush. Also, opposing exterior panels of each form section must be held in place without distortion of overall configuration of the form.

Tie brackets spanning inner and outer opposing panels of each section for providing support to the opposing panels of a form are known. However, most prior art tie brackets are designed with narrow focus on the immediate function of stabilizing a form. Ancillary functions, such as expediting assembly of the form and supporting elements of plumbing, power, and communications systems of the completed structure, are not provided for in known prior art tie brackets.

U.S. Pat. No. 4,730,422, issued to David A. Young on Mar. 15, 1988, shows a tie for supporting and bracing panels of a left-in-place form. The tie has spaced apart parallel end plates and a spanning web. The web includes two open areas and four short projections for retaining reinforcing rods. However, the tie of Young cannot accommodate plumbing and electrical elements as can the novel tie bracket, and is not conducive to being sawed horizontally in half, both being characteristics of the present invention.

U.S. Pat. No. 5,459,971, issued to Alan Sparkman on Oct. 24, 1995, shows a tie for concrete forms which tie, despite its several interior openings, cannot accommodate placement of plumbing and electrical elements from the side as can the novel tie bracket. The tie of Sparkman is not conducive to being sawed horizontally in half in the manner of the novel tie bracket.

U.S. Pat. No. 5,845,449, issued to Jamieson R. Vaughan et al. on Dec. 8, 1998, shows a tie for a concrete forming system. The subject tie includes many interior openings, but these openings lack the proportions and dimensions which enable the novel tie bracket to be highly compatible with plumbing and electrical elements, interfitting notches and projections which enable vertically stacked forms to be advantageously aligned, and to be sawed horizontally.

None of the above inventions and patents, taken either singly or in combination, is seen to describe the instant invention as claimed.

SUMMARY OF THE INVENTION

The present invention sets forth a tie bracket for connecting and bracing opposed insulation panels of an insulating concrete form system, and forms incorporating the same. The tie bracket includes opposed, spaced apart parallel plates spanned by structural connecting members. The connecting members comprise horizontal and vertical webs imparting great strength to the connecting members while requiring minimal constituent material. The plates form structural studs embedded in each insulation panel of the form. The plates are full height in that they extend the same vertical distance as the expanded foam insulating panel.

An important characteristic of the novel tie bracket is that it accommodates elements of electrical, heating, ventilating, air conditioning, and plumbing systems which may be installed in the building. To this end, the tie bracket has interior openings for accommodating reinforcing bars, electrical cables, and plumbing and heating, ventilating and air conditioning conduits passed therethrough. Several openings are dimensioned and configured to cooperate with standard electrical work boxes installed in the wall built using the insulating forms. An upwardly open retainer or saddle accommodates vertically stacked, horizontally laid reinforcing bars. This feature enables reinforcement bars to be spliced and still closely received within the saddle. One series of adjacent openings accommodates horizontal sawing of the tie bracket and an associated form incorporating two expanded foam insulating panels connected by the bracket. Additional openings are provided for tying off tether lines for scaffolding, bracing, and reinforcement bars.

Another significant feature of the form is that it enables succeeding courses to be aligned vertically. To this end, castellations are formed in the top surfaces of the forms, with corresponding notches formed in the lower surfaces.

Accordingly, it is one object of the invention to provide a tie bracket for connecting and bracing opposing panels of an insulating concrete form system.

It is another object of the invention that the tie bracket and associated insulating concrete form accommodate elements of electrical, plumbing, heating, ventilating, and air conditioning systems.

It is a further object of the invention to enable the tie bracket and its associated insulating concrete form to be horizontally sawed in half without diminishing structural integrity of the remaining portions of the tie bracket.

Still another object of the invention is to provide a saddle enabling plural reinforcing bars to be laid one above the other on and retained by the tie bracket.

An additional object of the invention is to provide additional openings for accommodating tethers for scaffolding, bracing, and reinforcement bars.

Yet a further object of the invention is to promote vertical alignment of stacked forms.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
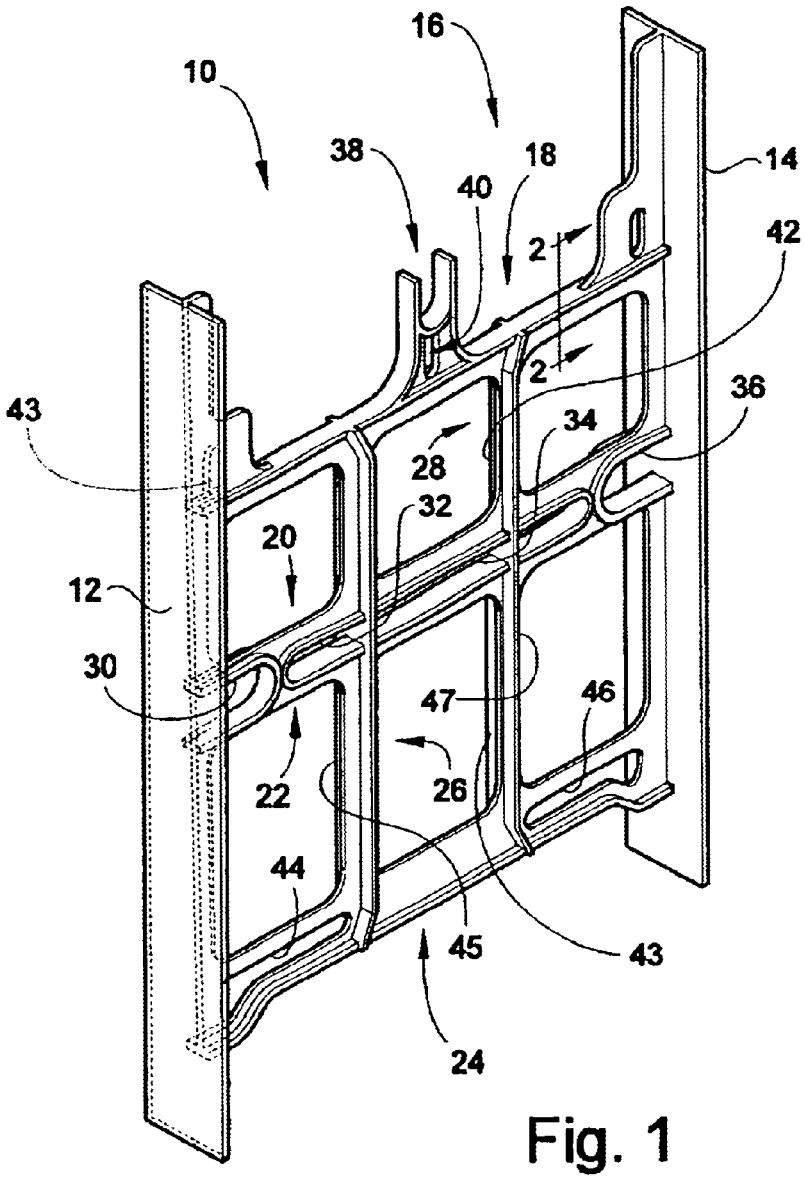
FIG. 1 is a perspective view of one embodiment of a wall tie bracket according to the present invention.
Figure 2:
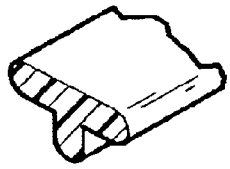
FIG. 2 is a cross sectional detail view taken along line 2—2 of FIG. 1.

FIG. 1 of the drawings shows a wall tie bracket 10 according to the present invention. Tie bracket 10 comprises a first elongate plate 12, a second elongate plate 14 spaced apart from plate 12, and a web 16 securing plates 12, 14 in spaced apart relation. Web 16 includes a plurality of vertically spaced apart spanning members 18, 20, 22, 24 which extend horizontally, in the depiction of FIG. 1, from plate 12 to plate 14, to join plates 12 and 14 structurally. Spanning members 18 20, 22, 24 are connected to one another by braces 26, 28. Spanning members 18, 20, 22, 24 and braces 26, 28 are preferably formed by intersecting straps selectively orthogonally oriented to one another, as shown in FIG. 2. Another way to describe this is to say that each of the spanning members and braces are formed of a plurality of orthogonal ridges extending alone substantially the full length of the spanning member or brace, such that each spanning member or brace has a cross-sectional shave of a "T"(as shown in FIG. 2) or a "+". First elongate plate 12 and second elongate elate 14 can also each be seen in FIG. 1 to have an orthogonal ridge extending substantially along the full length of each. This cross sectional configuration maximizes strength of the respective member while minimizing the amount of constituent material thereof. Circumferentially closed openings are thus formed in web 16.

At least two horizontal rows of circumferentially closed openings are formed when plates 12, 14 are oriented vertically, as shown in FIG. 1, there being at least two adjacent openings in each horizontal row. The arrangement of openings between horizontal and vertical members results in a very useful array of openings. First, it will be seen that outer openings 30, 36 and inner or central openings 32, 34, all formed between spanning members 20, 22 are oriented such that their lengths extend horizontally. Additionally, it can be seen in FIG. 1 that the orthogonal ridge which extends down one side of each plate 12, 14 has a break therein which coincides with the outer openings 30, 36. As a consequence, with the center lines of outer openings 30, 36 and central openings 32, 34 arranged in a line, and the break in the orthogonal ridge of plates 12, 14, it is easy for a mechanic to saw through tie bracket 10 horizontally without diminishing structural integrity of either remaining section of the tie bracket and of the entire form module. This must occasionally be done to create a form half the height of the uncut form to limit form height to the desired height of a finished wall. Furthermore, location of end openings 30, 36 where they terminate respectively at plates 12, 14 creates convenient electrical cable and conduit chases. To protect cables, openings 30, 36 are bounded by horizontally oriented straps. That is, the width of the strap is parallel to at least one, and preferably both, of plates 12, 14. It will be seen that outer openings 30, 36 each has a height greater than that of central openings 32, 34. The extra height of openings 30, 36 accommodates plural cables and conduits, whereas central openings 32, 34 require only nominal height for accommodating a saw blade. Openings 45, 47 are each dimensioned and configured to receive an electrical work box (not shown) which may be installed by sawing away an appropriate portion of plate 12 or 14.

Uppermost spanning member 18 has an upwardly open receptacle 38 for receiving reinforcing bars (not shown). The height of receptacle 38 is greater than the width, so that two sections of reinforcing bards can be laid in receptacle 38 and supported in overlying, overlapping relationship to facilitate splicing. Uppermost spanning member 18 also has a small circumferentially closed openings 40, 42, and 43 located above spanning member 18. Openings 40, 42, and 43 accommodate tie wires and tethers for scaffolding (not shown), bracing (not shown), and general purpose securement to tie bracket 10 and larger elements such as plumbing and HVAC conduits. Lowermost spanning member 24 similarly has two openings 44, 46 formed therein.

Figure 3:
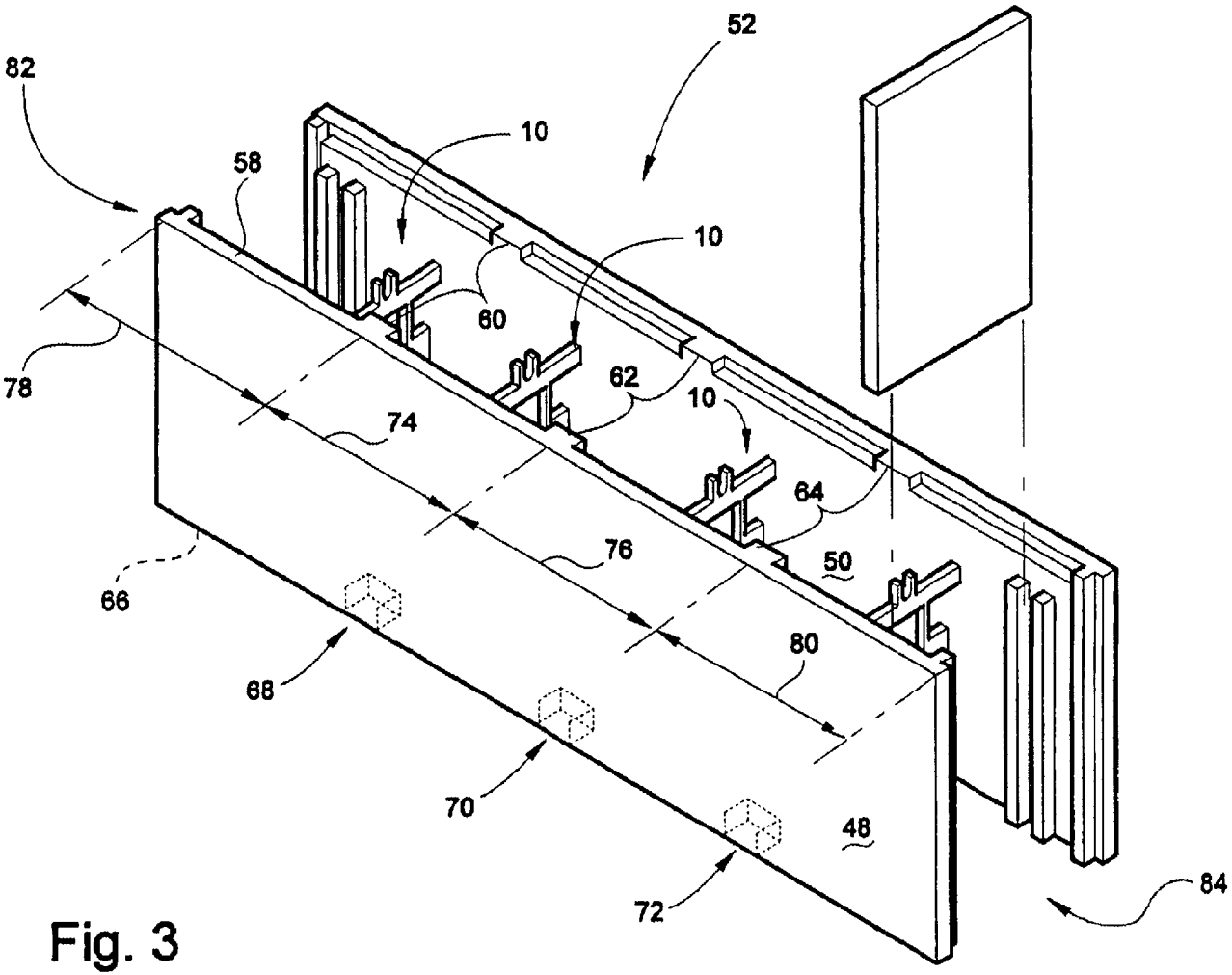
FIG. 3 is a partially exploded perspective view of one embodiment of a form incorporating wall tie brackets of the type shown in FIG. 1.
Figure 4:
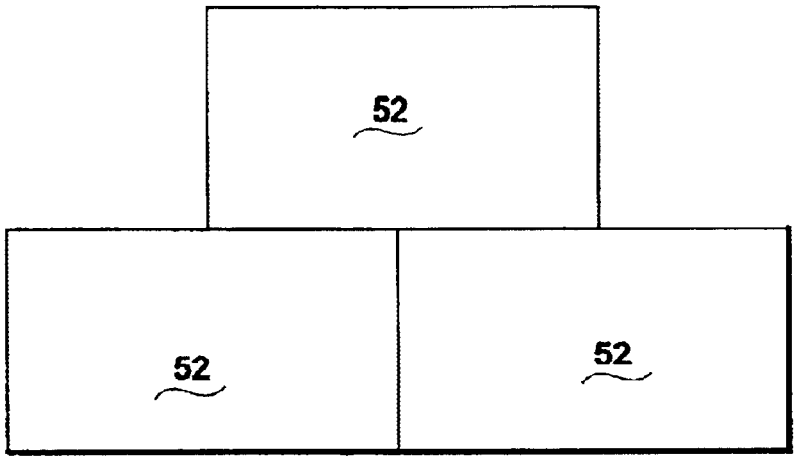
FIG. 4 is a diagrammatic, side elevational view of three forms of the embodiment of FIG. 3, shown interlockingly assembled.

Referring now to FIG. 3, the principal function of tie bracket 10 is to connect opposing insulating panels 48, 50 of insulating concrete forms for the purpose of holding panels 48, 50. Panel 48 is an insulating panel preferably formed from expanded foam. Panel 50 is a second insulating panel formed from expanded foam, and is located on the opposed side of the final form 52 comprising panels 48 and 50 and a plurality of tie brackets 10. Tie brackets 10 span and connect panels 48 and 50. Panels 48 and 50 are dimensioned and configured such that the height of each plate 12 or 14 (see FIG. 1) of the various tie brackets 10 are equal to the height of each panel 48 or 50. This characteristic improves vertical load bearing strength of the form.

Form 52 is dimensioned and configured so that as succeeding courses of forms 52 are formed by stacking forms 52 on one another, they interlock with one another. This characteristic is enabled by cooperating projections 60, 62, 64 and notches 68, 70, 72. Upper surface 58 of panel 48 has a plurality of inward projections 60, 62, 64 formed therein. Panel 50 is essentially a mirror image of panel 48, so that description set forth regarding panel 48 will be understood to apply equally to panel 50. Lower surface 66 of panel 48 bears notches 68, 70, 72 corresponding to projections 60, 62, 64. Each notch 68, 70, or 72 is dimensioned and configured to receive one projection 60, 62, or 64 of another form 52 in close cooperation therewith such that a form 52 placed above can interlock with a form 52 located below when pressed into mutual engagement. To this end, notches 68, 70, 72 are located directly below respective projections 60, 62, 64.

Location and spacing of projections 60, 62, and 64 and, of course, corresponding notches 68, 70, 72 are arranged to enable both direct vertical registry of forms 52 when stacked, and also overlapping relationship. This is accomplished by spacing apart adjacent projections 60, 62, 64 and corresponding notches 68, 70, 72 at regularly occurring intervals 74, 76. Notches 68, 72 may be said to be end notches since each is the last notch on its respective end of panel 48, and is adjacent to only one other notch (namely, notch 70). Panel 48 has a first end 82 and a second end 84.

The present invention is susceptible to variations and modifications which may be introduced thereto without departing from the inventive concept. Illustratively, there is no necessity that projections 60, 62, 64 be inwardly directed. They could be outwardly, upwardly, or otherwise directed if desired as long as they accommodate interlocking as described herein.

It is to be understood that the present invention is not limited to the embodiments described above, but encompasses any and all embodiments within the scope of the following claims.

I claim:

1. A tie bracket for connecting opposing insulating panels of insulating concrete forms, comprising a first elongate plate, a second elongate plate spaced apart from said first elongate plate, said first and second elongate plates having a height, and a web securing said first plate and said second plate in spaced apart relation, wherein said web forms a plurality of circumferentially closed, rounded openings arranged in at least two horizontal rows when said plates are oriented vertically, wherein each horizontal row includes at least two adjacent said openings;

said web further including an additional horizontal row of circumferentially closed, rounded openings, whose centerlines are arranged in a line and located to bisect the height of said first and second elongate plates, the openings of said additional horizontal row being elongated in a horizontal direction and having only a nominal height to accommodate and guide a saw blade, and said web includes a plurality of vertically spaced apart spanning members extending from said first plate to said second plate, including an uppermost spanning member and a lowermost spanning member, and said plates extend above and below both said uppermost and lowermost spanning member, and wherein each said spanning member comprises intersecting straps selectively orthogonally oriented relative to said spanning members thereby maximizing strength thereof.

2. The tie bracket according to claim 1, wherein said web includes at least one brace connecting at least two of said spanning members, wherein said brace comprises intersecting straps selectively orthogonally oriented relative to said brace.

3. The tie bracket according to claim 2, further comprising an upwardly open receptacle, the interior of said receptacle having a height greater than its width.

4. The tie bracket according to claim 1, wherein said additional horizontal row of circumferentially closed, rounded openings includes at least three elongated openings including a first outer opening, a second outer opening, and a central opening located between said first outer opening and said second outer opening, said first outer opening and said second outer opening each has height greater than that of said central opening.

5. The tie bracket according to claim 1, further comprising at least one circumferentially closed opening located entirely above said uppermost spanning member.

6. The tie bracket according to claim 1, wherein said lowermost spanning member has at least one circumferentially closed, rounded opening formed therein.

7. A tie bracket for connecting opposing insulating concrete forms, comprising a first elongate plate, a second elongate plate spaced apart from said first elongate plate, and a web securing said first plate and said second plate in spaced apart relation, wherein said web forms a plurality of circumferentially closed openings arranged in at least two horizontal rows when said plates are oriented vertically, wherein each said horizontal row includes at least two adjacent said openings, wherein one said horizontal row of openings includes at least two openings oriented such that the length of each one of said two openings extends horizontally, one said horizontal row of openings includes at least three openings including a first outer opening, a second outer opening, and a central opening located between said first outer opening and said second outer opening, wherein said first outer opening and said second outer opening each has height greater than that of said central opening, and said first outer opening and said second outer opening each are bounded by a said strap oriented with its width parallel to at least one of said first plate and said second plate, wherein said first outer opening, said second outer opening and said central opening are oriented such that each one of their respective lengths extends horizontally, and wherein said web includes a plurality of vertically spaced apart spanning members extending form said first plate to said second plate, including an uppermost spanning member and a lowermost spanning member, wherein each said spanning member comprises intersecting straps selectively orthogonally oriented relative to one another, said web includes at least one brace connecting at least two of said spanning members, wherein said brace comprises intersecting straps selectively orthogonally oriented relative to one another, an upwardly open receptacle having width and a height greater than the width, at least one circumferentially closed opening located above said uppermost spanning member, and at least one circumferentially closed opening formed therein.

8. A form having a first insulating panel formed from expanded foam, a second opposed insulating panel formed from expanded foam, and a tie bracket spanning and connecting said first insulating panel and said second insulating panel, wherein said tie bracket includes a web having a first and embedded within said first insulating panel and a second end embedded within said second insulating panel, said first and second insulating panels having a height, and wherein said web forms a plurality of circumferentially closed, rounded openings arranged in at least two horizontal rows when said plates are oriented vertically, wherein each said horizontal row includes at least two adjacent said openings; and wherein said first insulating panel and said second insulating panel each have an upper surface, a plurality of projections formed in said upper surface, a lower surface, and a plurality of notches formed in said lower surface, wherein each said notch is dimensioned and configured to receive said projection therein in close cooperation therewith, and each said notch is directly below one said projection; and wherein all said notches of one said insulating panel are regularly spaced apart from adjacent said notches of said insulating panel by equal distance intervals, said notches include a first end notch adjacent to only one other said notch and a second end notch adjacent to only one other said notch, said insulating panel has a first end and a second end, and said first end notch is spaced apart from said first end by a distance interval of half the magnitude of the magnitude of said distance intervals between adjacent said notches.

9. The form according to claim 8, wherein one said horizontal row of openings includes at least two openings oriented such that the length of each one of said two openings extends horizontally.

10. The form according to claim 8, wherein one said horizontal row of openings includes at least three openings including a first outer opening, a second outer opening, and a central opening located between said first outer opening and said second outer opening, wherein said first outer opening, said second outer opening, and said central opening are oriented such that each one of their respective lengths extends horizontally.

11. The form according to claim 8, wherein said web includes a first plate located at said first end, a second plate located at said second end, a plurality of vertically spaced apart spanning members extending from said first plate to said second plate, including an uppermost spanning member and a lowermost spanning member, wherein each said spanning member comprises intersecting straps selectively orthogonally oriented relative to said spanning members for maximizing strength thereof, said plates extending above and below both said uppermost spanning member and said lowermost spanning member, thereby extending the full height of said first and second insulating panels.

12. The form according to claim 11, wherein said web includes at least one brace connecting at least two of said spanning members, wherein said brace comprising intersecting straps selectively orthogonally oriented relative to said brace.

13. The form according to claim 11, wherein the uppermost spanning member of said web further comprises an upwardly open receptacle having a width and a height is greater than the width.

14. The form according to claim 11, wherein each said panel and said second insulating panel.

15. A tie bracket for connecting opposing insulating panels of insulating concrete forms, comprising a first elongate plate, a second elongate plate spaced apart from said first elongate plate, and a web securing said first plate and said second plate in spaced apart relation, wherein said web forms a plurality of circumferentially closed, rounded openings arranged in at least two horizontal rows when said plates are oriented vertically, wherein each horizontal row includes at least two adjacent said openings; one said horizontal row of openings including at least three elongated openings including a first outer opening, a second outer opening, and a central opening located between said first outer opening and said second outer opening, wherein said first outer opening, said second outer opening, and said central opening are oriented such that each one of their respective lengths extends horizontally; and said web includes a plurality of vertically spaced apart spanning members extending from said first plate to said second plate, including an uppermost spanning member and a lowermost spanning member, and said plates extend above and below both said uppermost and lowermost spanning member, and wherein each said spanning member comprises intersecting straps selectively orthogonally oriented relative to said spanning members thereby maximizing strength thereof, wherein said first elongate plate and said second elongate plate each have an orthogonal ridge extending substantially along the full length of an interior face thereof, with a break in each ridge located along the portion of each elongate plate that coincides with a respective one of the first outer opening and the second outer opening.

16. A tie bracket for connecting opposing insulating panels of insulating concrete forms, said tie bracket comprising:

a first elongate plate, a second elongate plate spaced apart from said first elongate plate, said first and second elongate plates having a height, and a web securing said first plate and said second plate in spaced apart relation, said web forming a plurality of circumferentially closed openings arranged in at least two horizontal rows when said plates are oriented vertically, each horizontal row including at least two adjacent said openings;

said web further including an additional horizontal row of circumferentially closed, rounded openings, whose centerlines are arranged in a line and located to bisect the height of said first and second elongate plates, the openings of said additional horizontal row being elongated in a horizontal direction and having only a nominal height to accommodate and guide a saw blade, said web including a plurality of vertically spaced apart spanning members extending from said first plate to said second plate, including an uppermost spanning member and a lowermost spanning member;

said plates each extending above said uppermost spanning member and below said lowermost spanning member, and wherein each said spanning member comprises a plurality of orthogonal ridges extending along substantially the full length of the spanning member, thereby maximizing the strength thereof.

* * * * *